United States Patent [19]

Coho et al.

[11] 4,072,435

[45] Feb. 7, 1978

[54] METHOD AND APPARATUS FOR MAINTAINING HIGHWAYS

[75] Inventors: Ralph W. Coho; John L. Kugle, both of Lancaster; Robert C. Futty, Willow Street, all of Pa.

[73] Assignee: IRL Daffin Associates, Inc., Lancaster, Pa.

[21] Appl. No.: 741,060

[22] Filed: Nov. 11, 1976

[51] Int. Cl.[2] ..... E01C 19/10

[52] U.S. Cl. ..... 404/110; 404/75; 404/92

[58] Field of Search ..... 404/110, 108, 101, 83, 404/79, 75, 111

[56] References Cited

U.S. PATENT DOCUMENTS

| | | | |
|---|---|---|---|
| 1,128,174 | 2/1915 | Moore | 404/108 |
| 1,714,659 | 5/1929 | Chausse | 404/108 |
| 1,813,728 | 7/1931 | Chase | 404/83 X |
| 2,669,915 | 2/1954 | McConnaughay | 404/108 |
| 3,055,280 | 9/1962 | Neville | 404/95 |
| 3,396,644 | 8/1968 | Banks | 404/108 X |
| 3,398,662 | 8/1968 | Takata | 404/108 X |
| 3,564,985 | 2/1971 | Heller | 404/95 |
| 3,625,489 | 12/1971 | Weaver | 404/95 X |
| 3,771,893 | 11/1973 | Miller | 404/101 |
| 3,820,914 | 6/1974 | Zimmerman | 404/110 |

*Primary Examiner*—Nile C. Byers
*Attorney, Agent, or Firm*—Holman & Stern

[57] ABSTRACT

Method and apparatus for maintaining a road or the like wherein liquid asphalt cement and aggregate are separately carried to a job site. The temperature of both of these is maintained within a range of from about 70° F to about 250° F for the aggregate and a range of from about 100° F to about 195° F for the liquid asphalt cement. The aggregate is metered onto delivery means and delivered thereby to a mixing means. The liquid asphalt cement is pumped from its container to the mixing means whereupon the aggregate and the liquid asphalt cement are mixed together and delivered to a spreading means. In addition, a filler hopper and metering means for filler material can be provided as well as a second tank for water with associated metering and piping means can be used. Two specific embodiments of the mixing means are presented, namely, a homogenizing mixer and a mix-conveyor. Auxiliary power means are provided for powering the moving elements of the apparatus. Infrared heating means can be used to heat the aggregate and/or filler material prior to their entry into the mixing means. The entire apparatus is mounted on a mobile frame, such as a truck.

21 Claims, 15 Drawing Figures

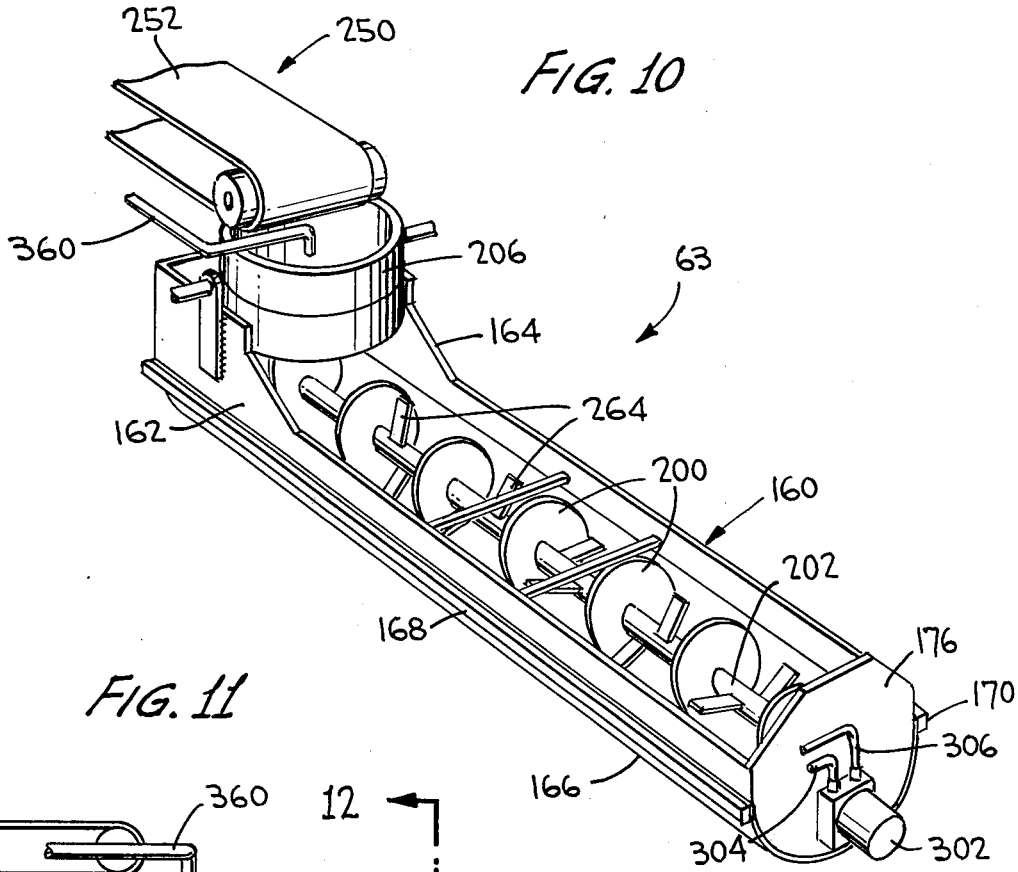
FIG. 10
FIG. 11
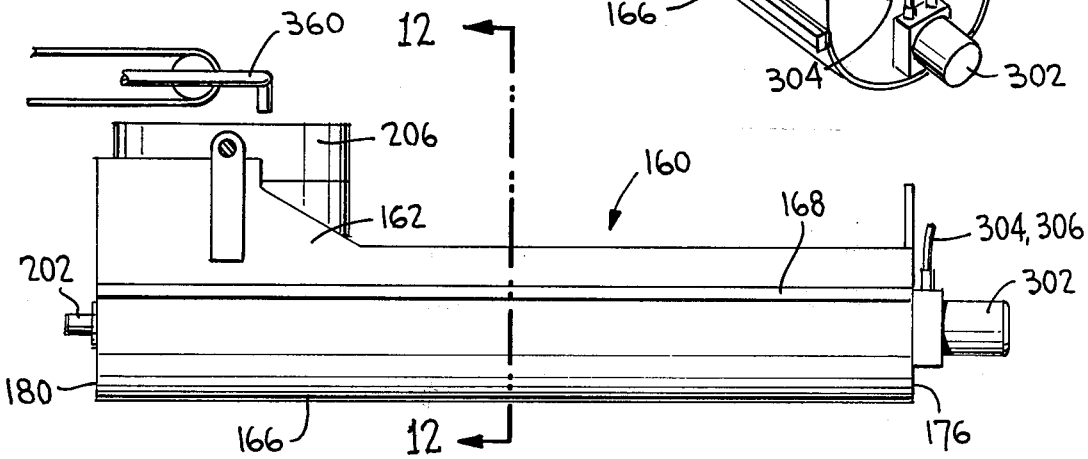
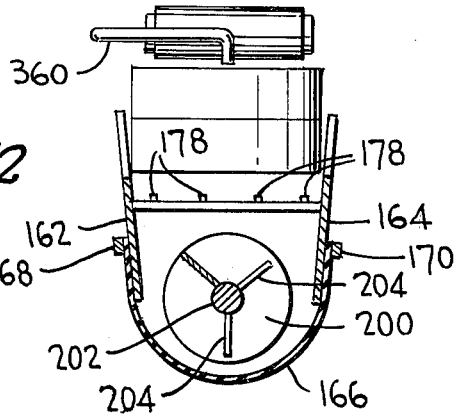
FIG. 12

METHOD AND APPARATUS FOR MAINTAINING HIGHWAYS

BACKGROUND OF THE INVENTION

This invention relates to a highway paving and coating machines and methods for their use and more particularly it relates to an apparatus and method for carrying the ingredients to a job site, and mixing and spreading the same for patching or coating a highway during any season of the year.

The need for patching and laying of roadway surfaces throughout the entire year has been a well known problem in the art. Generally, three different types of asphalt cement have been used. These are "hot," "cold cutback," and "cold emulsified" asphalts.

The purer the asphalt cement, the more dense and solid it is. In order for asphalt cement to be an effective binder in the production of asphalt concrete, it is necessary to transform it into a liquid state. In the case of "hot" asphalt paving materials, the more nearly pure asphalt cement is liquified by the use of heat up to as high as about 400° F. In order to maintain the binding strength of the asphalt cement at the time of the production of the "hot" paving materials, the aggregates (stone, sand, and filler) must likewise be heated up to as high as about 500° F. An example of a prior art apparatus designed to do this is shown in U.S. Pat. No. 3,820,914, which is directed to a self contained mobile asphalt mixing and applying apparatus. The entire disclosure of the aforementioned patent is incorporated herein by reference. This apparatus is suitable for producing a "hot" asphalt material for patching or resurfacing of a roadway during the late spring, summer and early fall months of the year. However, it is generally the practice of the asphalt paving materials industry to produce "cold" asphalt materials for "cold patch" purposes during the winter months when it is not practical to operate a "hot" asphalt concrete paving materials plant. This is because of the high heat requirements in order to keep the asphalt material liquid during the winter while it is in storage.

"Cold" asphalt cements have the advantage of not requiring great amounts of heat while stored during the winter months. "Cold" asphalt cement is available at all times throughout the year and can be stored in a liquid condition with relatively little expense. Such liquid asphalts cements are generally produced as a by-product during the refining of the almost pure asphalt cement used in the "hot" process.

"Cold" asphalting is usually accomplished by either of two general methods. First of all, in addition to the impurities of the asphalt cement that will keep it in the working state, "cutbacks," such as naptha, diesel fuel, and kerosene, may be added to reduce the viscosity of the asphalt cement so that it can be used without the extensive application of heat. Thus, "cold cutback" asphalt cement is available for using during the winter months. However, these materials suffer from the major disadvantage that the cutbacks are highly volatile and therefore, hazardous to handle. Additionally, they consume valuable petroleum resources, and during the process of placement and curing, release these cutbacks to the atmosphere to contribute to the general air pollution. Secondly, "cold emulsified" asphalt, which is a combination of asphalt, soap and water, may be manufactured by mixing asphalt cement at the refinery with a solution of soap and water to produce a liquid asphalt cement that is less hazardous to handle than the "cold cutback" asphalt cements. While "cold emulsified" asphalt cement has been available for almost 50 years, it has only been recently that the ionic exchange characteristics of the asphalt cement, as applied to asphalt concrete paving materials, are now known. Rapid curing (RC) asphalt cement is a type of emulsified asphalt cement with inhibitors added to correct the ionic exchange characteristics of asphalt cements that has not been subjected to heat in the process of producing the paving materials.

Thus, "cold patch" materials are stock piled for use during the entire year. In order to prevent the asphalt materials from "setting up" or otherwise curing in the stock pile so that they would be impossible to use during winter, other types of materials are often added. Consequently, the very items that are used to keep the "cold emulsified" asphalt from setting up or otherwise curing must be immediately dissipated by exposure to air and the heat of the sun in order for the asphalt concrete paving materials to be consolidated and remain in place. Unfortunately, this generally just does not happen and the "cold patch" materials soon erode from the areas of placement, such as potholes, and thus the entire purpose of using the same is defeated.

Even though while kept in storage, "cold emulsified" asphalt cement is kept liquid by minimal additions of heat and stirring during the coldest of winter months, most of the standards in the paving industry require the ambient temperature to be about 50° F and rising before any of these materials should be applied to roadways.

Similar problems exist in the Portland Cement paving materials industry in that, as a general rule, Portland cement materials cannot be economically used for patching or resurfacing during the winter months.

OBJECTS AND SUMMARY OF THE INVENTION

The primary object of the present invention is to provide an apparatus and a method by which road repair and resurfacing can be accomplished more easily, more economically, and with longer lasting results during the winter months without the disadvantages enumerated above.

It is a further object of the instant invention to provide an apparatus which can transport asphalt concrete ingredients in separate compartments to the job site, whereat the apparatus can automatically proportion, mix, and apply asphalt concrete, thus assuring a consistent high quality asphalt concrete from job to job without waste of materials.

These and other objects which will become apparent as the description of the preferred embodiments of the instant invention proceeds wherein a method of "warm" patching and/or resurfacing of roadways is provided. The method consists of carrying the liquid asphalt and the aggregate to a job site in separate containers on a mobile frame, such as a truck. During the travel and at the job site, the temperature of the liquid asphalt cement is continuously maintained at a temperature of from about 100° F to about 195° F and the temperature of the aggregate is maintained at a temperature of from about 70° F to about 250° F. The liquid asphalt cement used is of the "cold emusified" type. After arriving at the job site, the aggregate is metered onto a delivery means for delivering the aggregate to the mixing means. Simultaneously, the liquid asphalt cement is pumped and metered from the liquid asphalt cement container to the mixing means. The liquid asphalt cement and the aggregate are then mixed together until a homogenous mixture is formed and the resulting mixture is spread onto the road either in the form of a patch or a complete new surface. Additionally, the surface of the roadway to be repaired can be preheated by conventional methods, for example, direct heating, or spraying of a tack coat. Such preheating of the area of placement will enable the asphalt concrete paving materials to knit into the cold and old asphalt paving adjacent to the point of placement of the new materials.

Further, filler materials can be carried in a separate container to the job site and metered along with the aggregate and thereafter mixed with the liquid asphalt cement before it is applied. This method can be carried out either as a semi-batch operation, wherein the materials are mixed and dumped in one place and then consolidated or as a continuous process, wherein the materials are mixed, laid and consolidated while the mobile frame is in motion. This can be accomplished by the addition of an auxiliary power means to power the delivery means, the pumping means, and the mixing means.

The present inventive method can be carried out in an apparatus comprising an elongated mobile frame, such as a truck, a storage bin placed on said frame for storing aggregate, a tank disposed on the frame for storing the liquid asphalt cement, the storage bin having a heating means for maintaining the temperature of the aggregate at a temperature of from about 70° F to about 250° F and the tank having a heating means for maintaining the liquid asphalt cement at a temperature of from about 100° F to about 195° F, a mixing means, a delivery means disposed to receive material fed from the storage bin and feed the same to the mixing means, a pump means coupled to the tank for discharging the liquid asphalt cement from the tank into the mixing means and a spreading means connected to the rearward end of the frame for spreading the mixed materials onto a road surface. The spreading means can be any conventional spreading means, such as a screed.

In one embodiment of the present inventive apparatus, the storage bin is divided into a plurality of separate compartments for storing a number of different aggregates, such as sand and stone. A metering means is provided, which can be of a conventional type, such as a multiple gate mechanism as seen in U.S. Pat. No. 3,310,293, the entire disclosure of which is also incorporated herein by reference. The liquid asphalt cement can also be metered by any conventional liquid metering means. Additionally, in one embodiment of the apparatus a filler material hopper is provided. These filler materials help to fill the voids formed in the combination of the liquid asphalt cement and the normal aggregate materials which makes it a tighter and more water proof mixture. Such fillers should be finer than about 100 mesh with 85% finer than about 200 mesh. Examples of filler materials are ground glass, scrap metal and Portland Cement. The filler hopper is provided with a separate powered metering means which discharges the filler materials onto the delivery means.

The delivery means can be a conventional endless belt-type conveyor disposed beneath the aggregate storage bin and the filler hopper having its discharge end over the mixing means.

One embodiment of the mixing means contemplated for use in the present invention is a specially modified form of a double-pug mill. As the materials to be mixed fall off of the end of the delivery means, they fall into a half-trough wherein a set of mixing blades are mounted on a powered shaft. The mixing blades are designed and set up to direct the materials toward the longitudinal center of the shaft. The materials are then directed to a second shaft parallel to and on the same horizontal level as the first shaft. The second shaft also supports a series of mixing blades, however, these blades direct the materials towards the ends of the shaft which also rests in a trough. At the ends of the trough, there are openings leading downwards to another mixing shaft in the form of a conveyor-auger which is totally enclosed. This conveyor auger further mixes the materials and direct them to the longitudinal center of the mixing apparatus whereupon the mixed materials drop from the mixing apparatus into the spreading means. The three shafts are all interconnected and powered to rotate simultaneously. The liquid asphalt cement is sprayed into the top of the second mixing blade assembly.

Such a mixer is used advantageously with anionic type emulsified asphalt cements because is provides a long retention time for the materials being mixed. This helps to dissipate any cutbacks, water, or other materials in the mix to provide faster curing times for the asphalt concrete. It is believed that the primary mixing takes place in the upper two mixing elements and that the auger conveyor is used to convey the materials back to the center to be dropped into the spreading means.

When cationic emulsified asphalt cements are used, the above described type of mixing means is not absolutely necessary. Instead, in another embodiment of the mixing means contemplated for use with the present invention, the mixing means comprises a mixing trough which pivotably extends from the rear of the mobile frame. This trough has a flexible bottom wall and a shaft extending longitudinally. A plurality of mixer elements are spaced along the shaft and the shaft is rotatably powered. As the materials drop off of the end of the delivery means, the drop into the end of the mixing trough, and are thereupon moved by the mixing elements to the opposite end thereof. Since cationic asphalt cement sets up faster than anionic asphalt cement, the residence time in the mixing means does not need to be as great as that provided by the mixing means described above. If Portland Cement is used in place of the asphalt cements described above, this second embodiment of the mixing means should be used.

The heating means for the aggregate storage bin and the heating means for the liquid asphalt cement tank are contemplated to be very similar in construction. They would comprise a heat generating means, a heat exchange means, and a venting means. The heat generating means can be of any conventional type, such as LPG burner with associated tank, a fuel oil burner, with associated storage tank, or perhaps some form of an electrical heating system and fan. The heat exchange means would simply be a series of conduits or pipes passing through the storage bin and tank respectively. The vent means are necessary to provide an exhaust for the combustion products of the heat generating means.

An additional source of heat for warming the aggregate is contemplated in another embodiment of the present invention. This additional means comprises a plurality of infrared heating means disposed above the delivery means along its length and directed such that the infrared radiation generated thereby heats the aggregate passing underneath.

In yet another embodiment of the present invention, an additional power means is provided on the mobile frame to enable the apparatus to operate at a uniform pace independent of whether or not the mobile frame is in motion. A standard internal combustion engine is contemplated for use as a power means although other conventional devices could be substituted therefor. The engine could either directly or indirectly power the various means of the apparatus. For example, the delivery means, the metering means for the filler material, and the pump means can be directly linked via shafts and belts or chain gear drives to the power means. The mixing means could be powered by a hydraulic motor which in turn is powered from a hydraulic pump directly connected to the power means. These methods of powering are merely meant to be illustrative.

For use with Portland Cement, a second tank for storing water would be added to the apparatus on the mobile frame. A third heating means similar to the heating means for the aggregate storage bin and the liquid asphalt cement tank would be present in the water tank to maintain the water at a temperature of from about 70° F to about 212° F. Pipe means for directing the water from the second tank to the mixing means is provided an a fourth metering means is interposed in the pipe means for metering the flow of water to the mixing means.

In this embodiment of the present invention, the filler hopper would carry as a filler material, Portland cement.

The various heating means used in the present invention permit the use of "cold emulsified" type asphalt cements with a minimum of impurities, such as cutbacks, during the entire year. Thus, even when "hot" asphalt cement is unavailable, a superior method of patching roads can be employed. Since the materials are each carried separately to the job site, there is no problem of the asphaltic concrete setting up before it is needed. Additionally, the air pollution generated by extensive use of cutbacks and the hazards associated therewith are avoided. The inventive apparatus and method can be used in extremely low ambient temperatures.

BRIEF DESCRIPTION OF THE DRAWINGS

The invention itself will be better understood and additional features and advantages thereof will become apparent from the following detailed description of the preferred embodiments, such description making reference to the appended sheets of drawings, wherein:

DETAILED DESCRIPTION OF PREFERRED EMBODIMENTS

Figure 1:
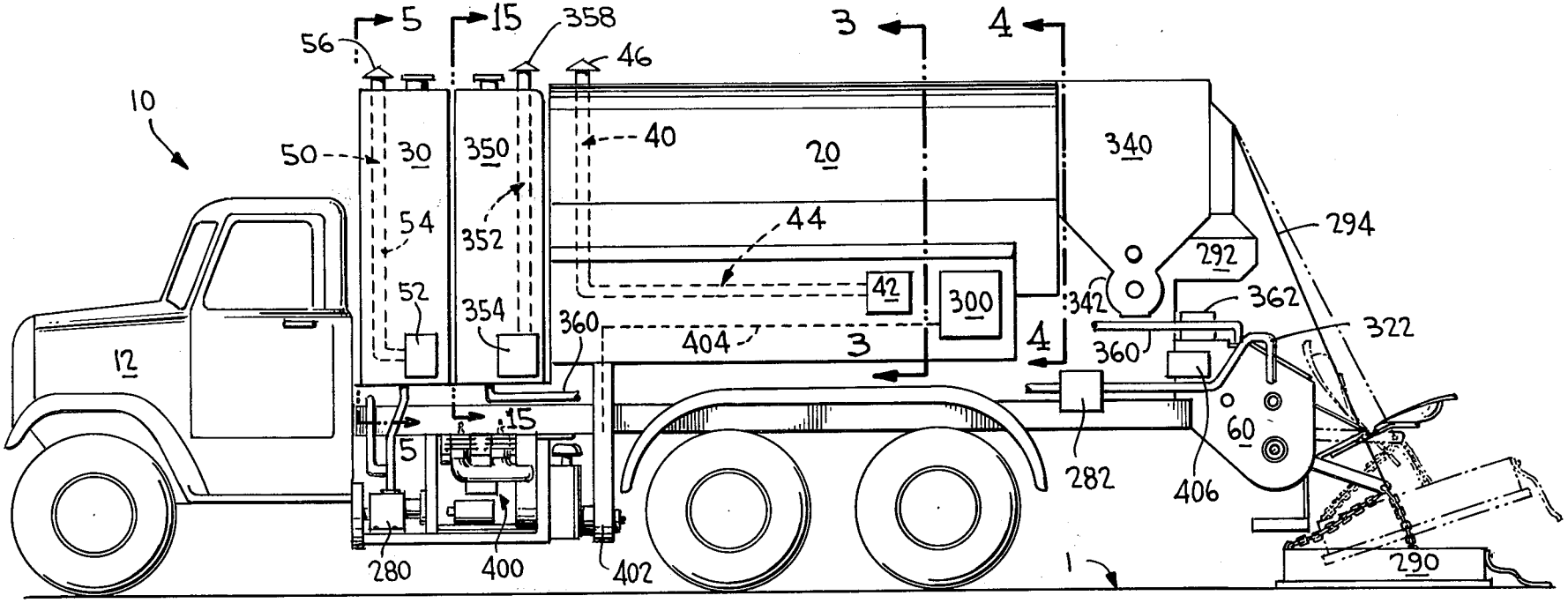
Figure 2:
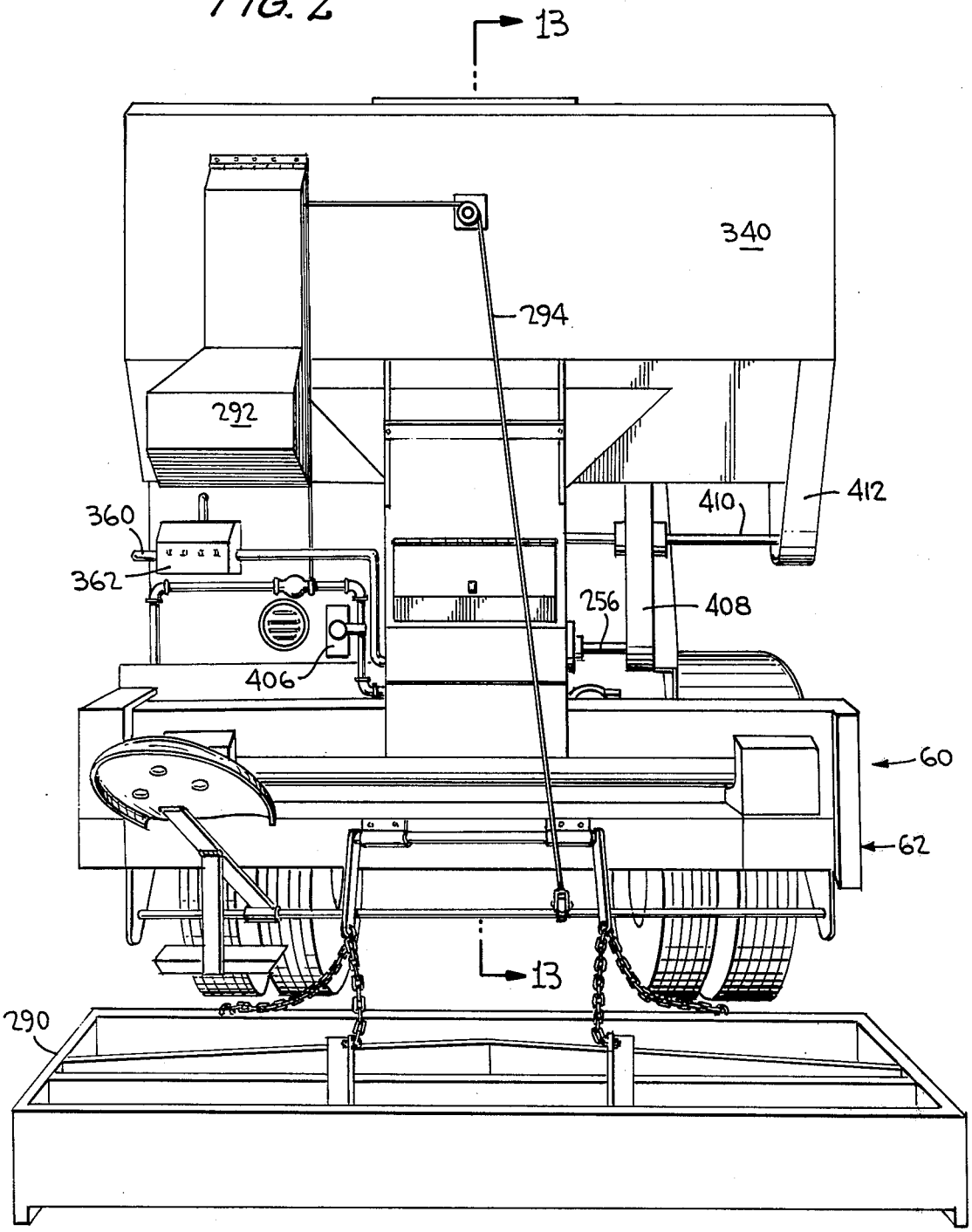
Figure 3:
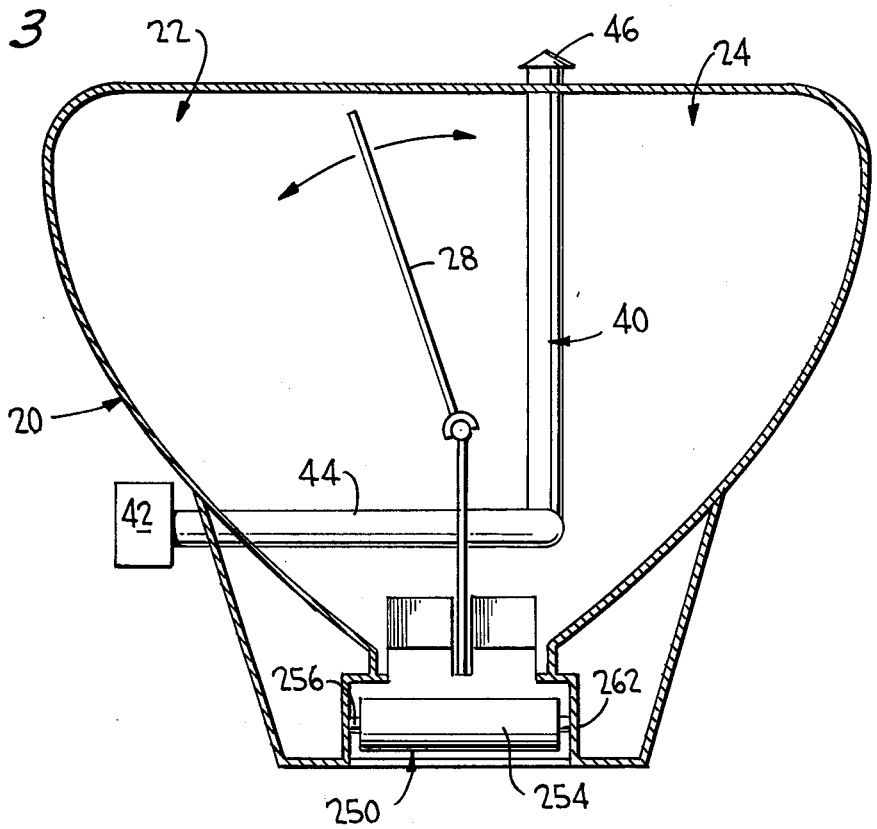
Figure 4:
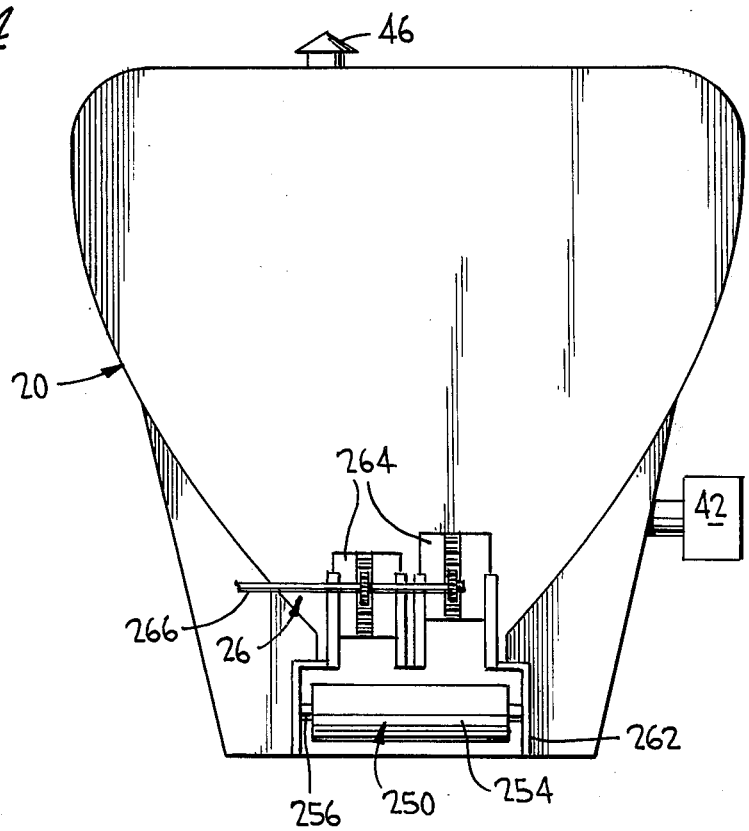
Figure 5:
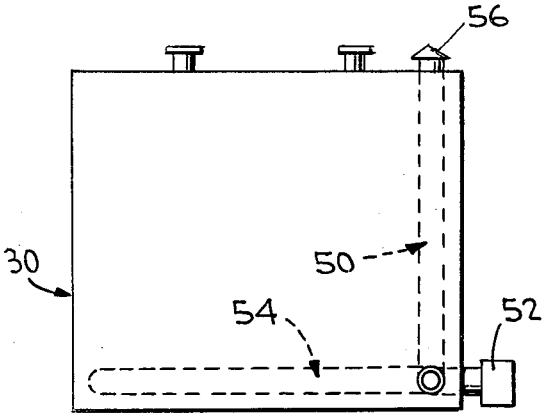
Figure 15:
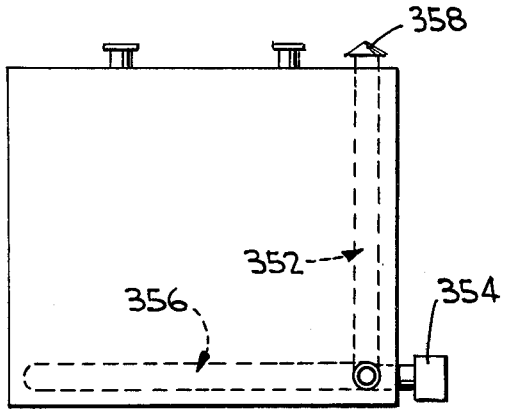
Figure 13:
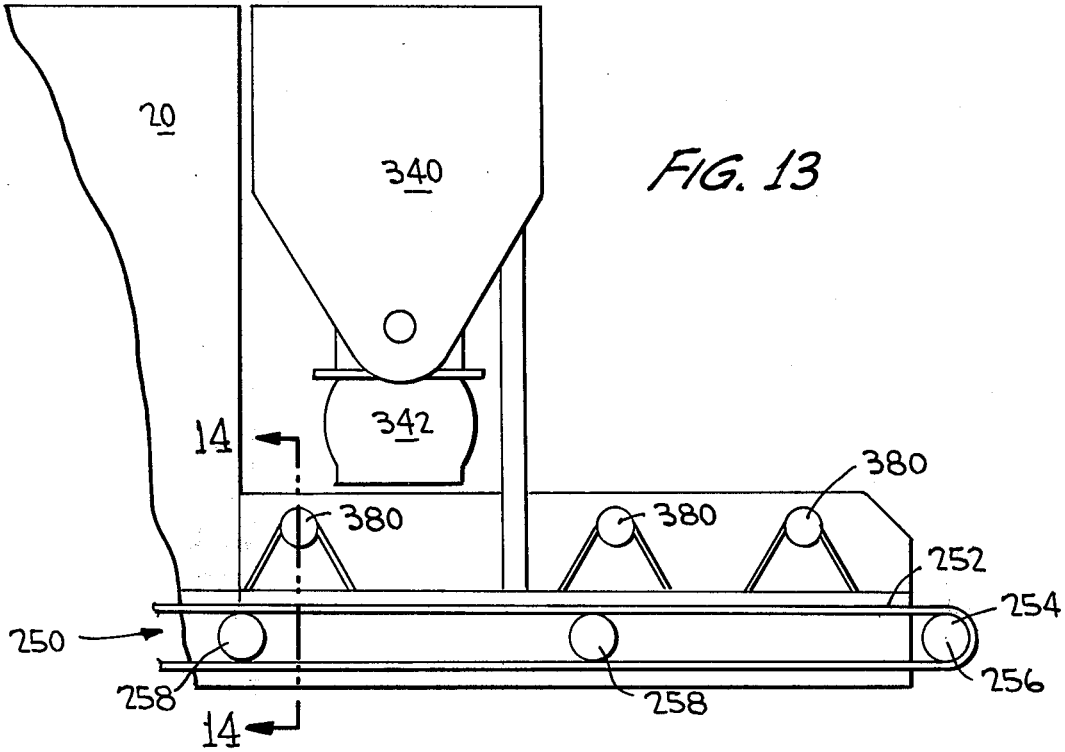
Figure 14:
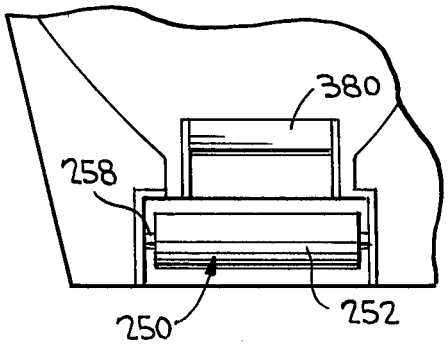
Figure 6:
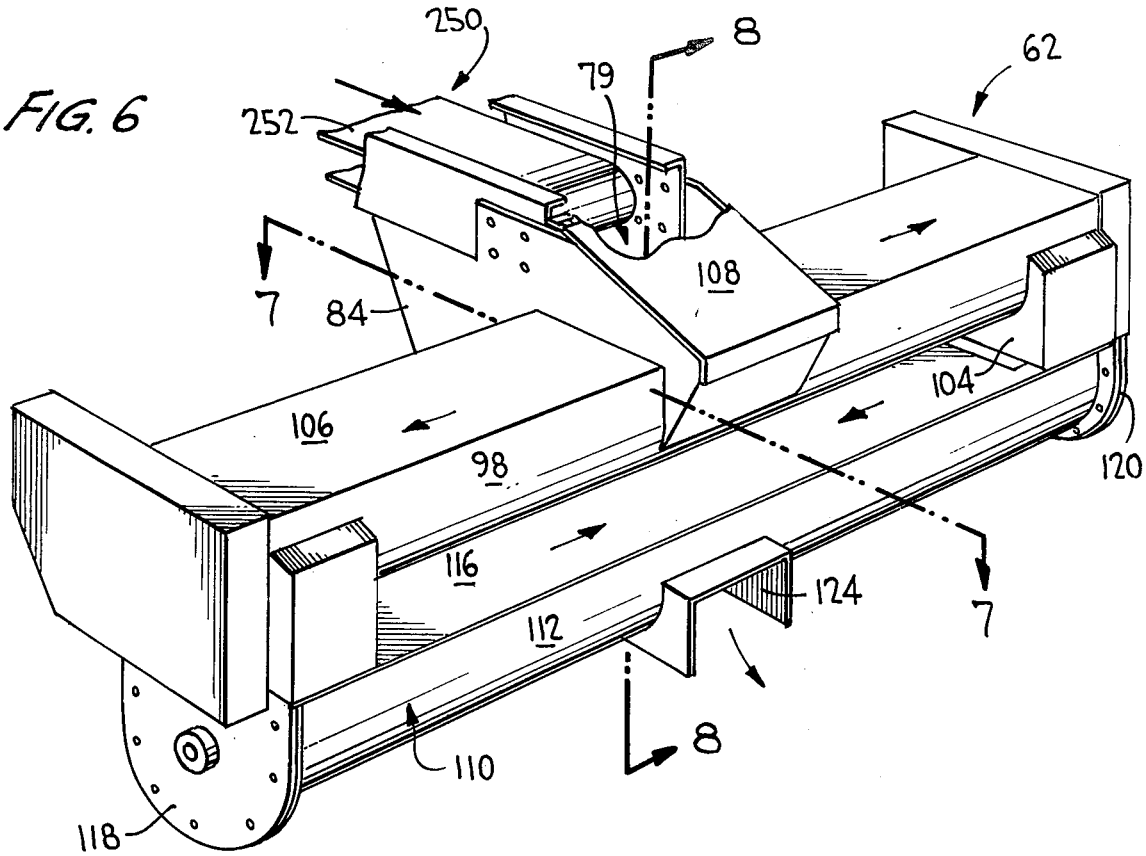
Figure 8:
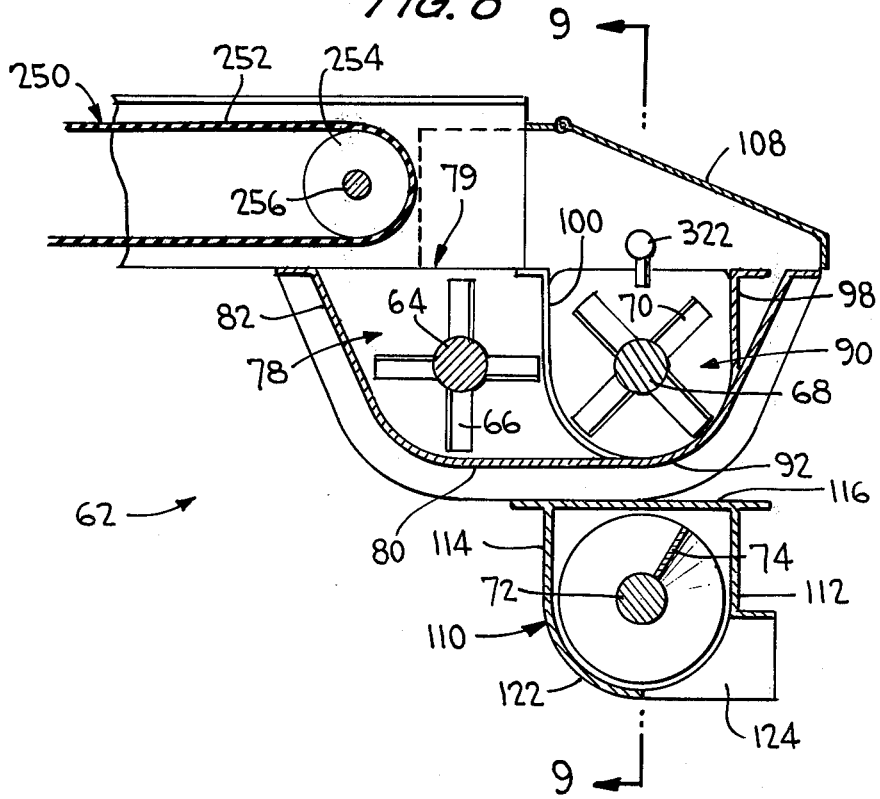
Figure 7:
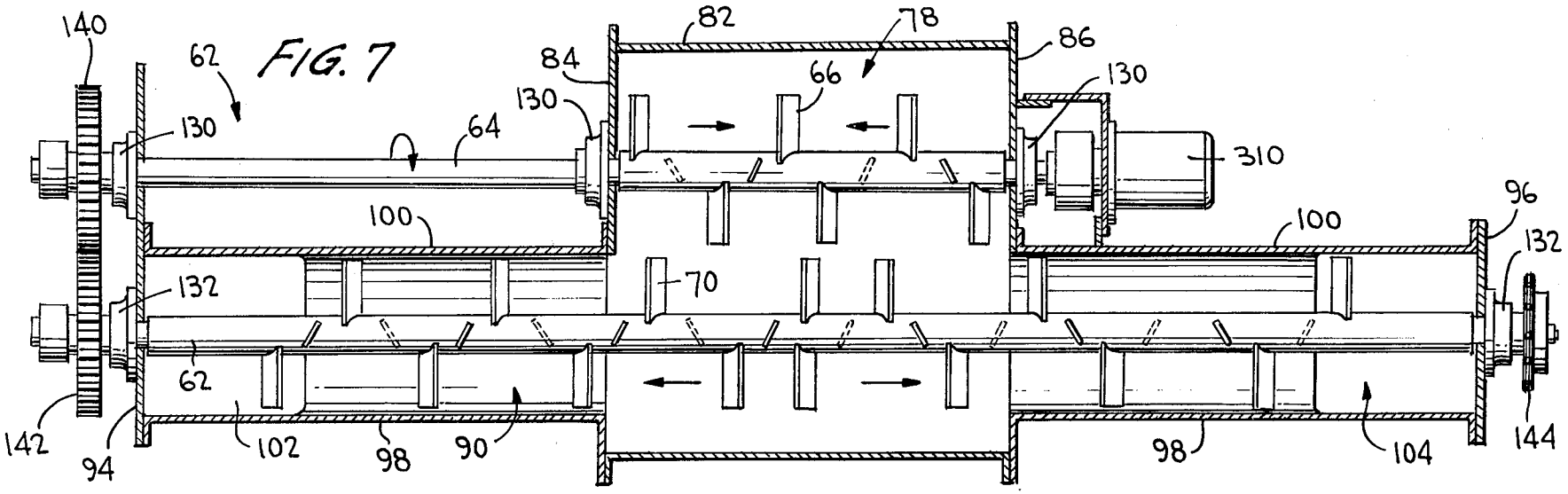
Figure 9:
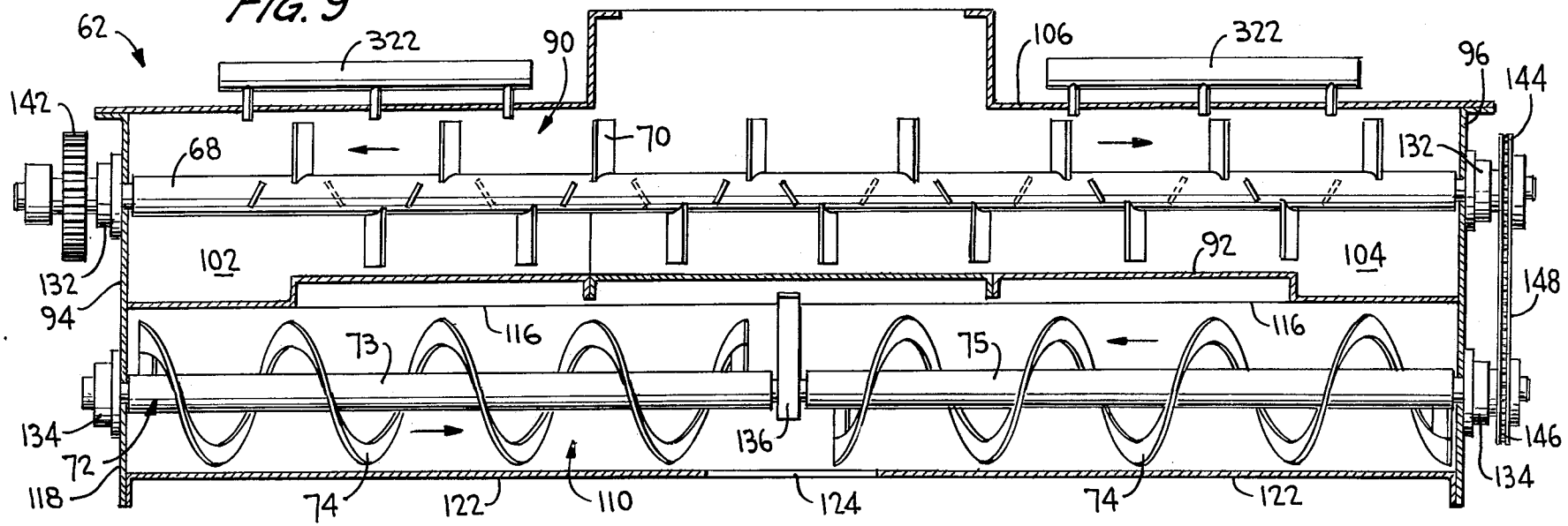

FIG. 1 shows a side elevational view of the inventive apparatus;

FIG. 2 shows a rear view thereof;

FIG. 3 shows a partial cross-sectional view taken along lines 3—3 of FIG. 1;

FIG. 4 shows a partial cross-sectional view taken along lines 4—4 of FIG. 1;

FIG. 5 shows a partial cross-sectional view taken along lines 5—5 of FIG. 1;

FIG. 6 shows an enlarged perspective view of one embodiment of the mixing means;

FIG. 7 shows a cross-sectional view taken along lines 6—6 of FIG. 6;

FIG. 8 shows a cross-sectional view taken along lines 7—7 of FIG. 6;

FIG. 9 shows a cross-sectional view taken along lines 8—8 of FIG. 8;

FIG. 10 shows an enlarged perspective view of another embodiment of the mixing means;

FIG. 11 shows a side view of FIG. 10;

FIG. 12 shows a cross-sectional view taken along lines 12—12 of FIG. 11;

FIG. 13 shows a partial cross-sectional view taken along lines 13—13 of FIG. 2;

FIG. 14 shows a partial cross-sectional view taken along lines 14—14 of FIG. 13; and FIG. 15 shows a partial cross-sectional view taken along lines 15—15 of FIG. 1.

Like reference characters refer to the same elements throughout the several views of the drawings.

Referring now to the drawings and particularly to FIG. 1 thereof, the novel apparatus of the present invention comprises a mobile frame 10 shown as a truck 12. Disposed on the frame 10 is storage bin 20 for storing aggregate. Forward of storage bin 20 is the first tank 30 for storing and holding the liquid asphalt cement. A first heating means 40 is contained in the storage bin for maintaining the aggregate at a temperature of from about 70° F to about 250° F. A second heating means 50 is contained within the first tank 30 for maintaining the liquid asphalt cement at a temperature of from about 100° F to about 195° F. A mixing means 60, attached to the frame 10, is disposed on the rearward end of the frame 10. A delivery means 250 is secured below the storage bin 20 for delivering the aggregate to the mixing means 60. A pump means 280 is coupled to the first tank 30 for discharging the liquid asphalt cement from the first tank 30 to the mixing means 60. A spreading means 290 is connected to the frame 10 and disposed below the mixing means 60 for spreading the materials which have been mixed in the mixing means 60 on the road surface to be repaired. The above described elements are the major parts of the inventive apparatus, each of the same will be described in more detail hereinafter.

The mobile frame 10 can be any conventional means of locomotion that is capable of carrying the necessary other elements. As shown in the drawings, a truck 12 is quite suitable. However, a tracked vehicle or apparatus is within the contemplation of the present invention.

The storage bin 20 preferably is of the type shown in U.S. Pat. No. 3,310,293 and is shown in cross section in FIG. 3 and an end view thereof is shown in FIG. 4. The storage bin 20 can be constructed with a number of separate compartments 22, 24 divided by a movable divider 28. In this manner, the inventive apparatus can carry and use a plurality of different aggregates. For example, these aggregates could include sand, stone, gravel, or any other material with which it is desirable to use as a solid base material for asphalt concrete. The storage bin 20 preferably has a metering means 26 incorporated therewith. The metering means 26 can be of a conventional type, for example, a pair of sliding gates 264 jointly and proportionally actuated by an actuator 266. This type of metering apparatus is more fully described in the aforementioned U.S. Pat. No. 3,310,293. The metering means 26 allows the aggregate to proportionally slide out upon the delivery means 250.

The first heating means 40 for maintaining the temperature of the aggregate in the storage bin from about 70° F to about 250° F, is generally shown as a first heat generating means 42, a first heat exchange means 44 and a first vent means 46. The heat generating means 42 can be of any conventional type provided that enough heat is generated to maintain the temperature of aggregate. For example, a liquid propane gas burner could be used with an associated storage tank and regulating means. A fuel oil burner system could be used as easily. Alternatively, a form of electric heating means with associated blower could also be used. The first heat exchange means 44 is generally shown as a single piping means extending down the length of the storage bin 20 and exiting from the top thereof. This piping means can be of any conventional heat exchange type. The vent means 46 provides an exit for the combustion gases. The second heating means 50 (FIG. 5) is very similar to the first heating means 40 and contains similar parts, namely, a second heat generating means 52, a second heat exchange means 54, and a second vent means 56. The specific forms of the second heat generating means 52 and the second heat exchange means 54 can take the same forms as described above with regard to the first heating means.

The mixing means 60, depending upon the materials to be mixed, is shown in two different preferred embodiments. The first of these embodiments 62 is hereinafter referred to as a homogenizer and is shown in detail in FIGS. 6–9.

Referring now to these Figures, the homogenizer 62 comprises three mixing elements. The first mixing element comprises a shaft means 64 carrying mixing blades 66. The mixing blades 66 are disposed to receive the materials dropped from the delivering means 250 and direct them towards the longitudinal center of the shaft 64 as shown by the arrows on FIG. 7. The first mixing element is disposed in a half trough 78 having an open top 79, a bottom 80, a forward wall 82 and end plates 86 and 84. As the first shaft means 64 passes through the end plates 84 and 86 respectively, it is supported and sealed by bearing means 130. The half trough 78 has only a forward wall 82 so that the material directed to the center of the shaft means 64 readily moves perpendicular to the shaft 64 into the second mixing element.

The second mixing element comprises a second shaft means 68 carrying mixing blades 70. These mixing blades 70 are arranged to direct the material delivered from the first mixing element to the opposite ends of the shaft 68 as shown by the arrows in FIGS. 7 and 9. The second shaft 68 and mixing blades 70 are carried in second trough 90 having a bottom 92, end plates 94, 96, one full rearward side 98, one partial forward side 100, top covering 106, and movable lid 108. The bottom 92 of the second trough 90 has two openings 102 and 104, one at each end. The materials being mixed by mixing blades 70 and directed towards the ends of shaft 68 falls through these openings 102, 104 into the third mixing element. The movable lid 108 is to enable the operator of the apparatus to occasionally check the mixing of the materials and to enable the apparatus to be cleaned. Disposed above mixing element 70 and shaft 68 are the liquid asphalts cement dispensers 322. These dispensers 322 spray the liquid asphalt cement upon the aggregate being moved to the mixing means 60.

The third mixing element of the homogenizer 62, includes an auger-conveyor 74 disposed on third shaft means 72. The auger-conveyor 74 is contained in a third closed top trough 110 having two side walls 112, 114, a top 116, two end plates 118, 120, and a partial bottom 122. The partial bottom has a central opening 124 to allow the mixed materials to be dropped out into the spreading means 290. The top 116 of the third closed top trough 110 has corresponding openings 102, 104 of the bottom 92 of the second trough 90. The materials mixed by mixing elements 70 in the second trough 90 drop through these openings 102 and 104 to the auger-conveyor 74 whereupon they move in the direction of the arrows in FIG. 9 to the central opening 124. The third shaft means 72 is divided into two portions 73 and 75. The shaft means 72 is generally supported at its ends by bearing and sealing means 134 disposed in the end plates 118 and 120 of the third closed top trough 110. Additionally, a bearing means 136 is disposed at the longitudinal center of the shaft means 72 to provide further support. Portions 73 and 75 of the third shaft means 72 are interconnected within the bearing means 136. Second shaft means 68 is supported at its ends by bearing and sealing means 132 supported in the end plates 94 and 96 of the second trough 90. The first shaft means 64 is operatively connected with the second shaft means 68 by means of gears 140 and 142. These gears 140 and 142 are shown merely as one of the many means by which these two shafts can be operatively connected. As an example of another method of connecting, second shaft means 68 is operatively connected with third shaft means 72 by means of gears 144 and 146 and a link belt or chain drive 148. These means of interconnecting the various shafts are illustrative only and are not meant in any way to limit the actual embodiments of the present invention because any person having skill in the art would be able to interconnect these shafts to enable them to be operated simultaneously. The mixing means 60 is powered by drive means 310. As shown in the drawings, drive means 310 is a hydraulic motor coupled to shaft means 64.

The homogenizer 62 is most advantageously used when anionic emulsion liquid asphalt cement is used in the inventive apparatus. The homogenizer 62 provides a longer retention time for dissipation of any cutback or impurity materials that may be contained therein.

Thus, the homogenizer 62 provides a better mixing of anionic emulsion liquid asphalt cement mixtures.

A second embodiment of the mixing means 60 is generally designated as mix-conveyor 63 and is of the type shown in detail in U.S. Pat. No. 3,310,293. The mix-conveyor 63, is generally shown in FIGS. 10–12, comprises a mixing trough 160 which includes a pair of fixed opposed side members 162 and 164 which extend longitudinally of the trough for the entire length thereof. These side members 162 and 164 form the upper side portions of the trough, the lower portion of the trough being formed by a flexible arcuate member 166. The flexible arcuate member 166 will be hereinafter generally designated as the flexible bottom 166. Flexible bottom 166 is attached to the side members 162 and 164 at 168 and 170. It should be herein understood that the flexible bottom 166 can take the form of a rubber sheet or any other known flexible composition having similar resistive characteristics so that abrasion thereon will not cause excessive wear thereof. It is important to understand that the flexible bottom 166 permits mixing trough 160 to accomodate course aggregate without malfunction of the mixing arrangement even on a continuous basis. The upper side portions 162 and 164 are maintained in spaced apart relation by the end plate 180 at the outermost end thereof. The side portions 162 and 164 further supported the longer longitudinal length by a grill or rod arrangement 178 which terminates inwardly of the inner and of the mixing trough 160 or in other words, terminates forwardly of the end wall 180 of the trough 160. A funnel member 206 is provided at the material entering end of the mixing trough 160 to direct materials coming from the delivery means 250 to the start of the mixer auger 63. The mixing trough 160 includes a plurality of spiral flights generally designated 200 disposed about the central longitudinally extending shaft 202. In addition to the spiral flights 200 a plurality of mixing blades 204 are also carried on the shaft 202. These mixing blades 204 serve to pick the material up from the periphery of the mixing trough and essentially drop the same to thereby affect a desired tumbling action for aiding in mixing. The shaft 202 along with its spiral flights 200 and mixing blades 204, provide an agitator and conveyor which properly mixes the material dispensed into the mixing trough and conveys the same rearwardly during the mixing operation. The shaft 202 is journaled in respective bearings at opposite ends and is powered by a means for driving 302. The means for driving 302 is shown in the drawings as a hydraulic motor. It should be understood that the illustration of a hydraulic motor as the means for driving 302 is merely illustrative in that any common conventional means for driving the shaft is to be within the scope of the present invention.

The delivery means generally designated by the reference numeral 250, shown in FIGS. 3, 4, 6, and 10–14 is illustrated in the general form of an endless belt type conveyor mounted on a frame 262 having an endless surface belt 252 driven by drive roller 254 mounted on shaft 256 and further supported by idler rollers 258 and driven by controllable means for driving 406. Any general conventional means of conveying the aggregate from the storage bin to the mixing means is contemplated to be within the scope of the present invention. The illustration of a conveyor type means is not intended to be any limitation because an auger-type means could just as readily be employed.

A pump means 280 (FIG. 1) is provided for discharging the liquid asphalt cement from the first tank 30 to the mixing means 60. A first metering means 282 is interposed between the pump means 280 and the mixing means 60. The pump means 280 can be of any conventional type of pump suitable for pumping liquid asphalt cement. For example, a standard centrifugal pump or a piston pump could be used. First metering means 282 is of any standard conventional type suitable for metering liquid asphalt cement.

The spreading means 290 (FIGS. 1 and 2) is of a standard conventional type and is shown in the form of a screed. A rake type spreading means could also be used. A consolidating roller could be mounted to the rear of the spreading means 290 or could be separately mobile. The spreading means 290 is provided with a winch 292 mounted on the rear of the apparatus with a cable 294 attached thereon whereby the spreading means can be lifted and deployed out of the way while the apparatus is not engaged in laying asphalt concrete (as shown by the dotted lines in FIG. 1). For example, when the apparatus is being turned around to make an additional pass or when the apparatus is moving between places to be patched, the spreading apparatus 290 would be lifted out of the way.

In certain mixes of asphalt concrete, additional filler materials such as scrap glass or metal or Portland cement may be used as additives. For this circumstance, in another embodiment of the present invention, a filler hopper 340 is secured to the frame above the delivery means 250 for carrying filler material to the job site. A third metering means 342 is provided on the filler hopper 340 for metering and dispensing the filler material. The third metering means can be of any conventional type as known in the art such as sliding gates or, as illustrated, a rotary drum metering apparatus as disclosed in U.S. Pat. No. 3,310,293.

A second tank 350 may be added to the apparatus for the purpose of carrying water. Water would be desirable when Portland cement is used as a filler material or by itself. The second tank 350 could contain a third heating means 352 (FIG. 15) similar in construction to the second heating means 50, namely, comprising a third heat generating means 354, a third heat exchange means 356, and a third vent means 358. The third heat generating means 354 could be any conventional heating means such as a LPG burner and tank, a fuel oil burner and tank, or an electric heating means and fan. The third heat exchange means 356 is shown as a conduit means and can be of any conventional form so long as it is capable of exchanging the heat from the third heat generating means to the water. The third vent means is provided for venting any of the hot gases from the water heating means. A pipe means 360 (shown in schematic on FIGS. 1, 2, 10–12) is provided to be able to supply the water from the second tank 350 to the mixing means 60. A fourth metering means 362 (shown in schematic on FIGS. 1 and 2) of any conventional type suitable for metering water, is provided in the pipe means 360 to accurately determine and control the amount of water added to the mixture.

In yet another embodiment of the invention, infrared heating means 380 are provided above the delivery means 250, as shown in FIGS. 13 and 14, to heat the aggregate as it passes therebeneath. These infrared heating means 380 can be of any conventional type. They can be used in conjunction with the first, second and third heating means during extremely cold weather, or in place thereof during warmer weather when only mild heating is needed.

A power means 400 is provided for powering the mixing means 60, the delivery means 250 and the pump means 280 and whatever else needs powering. As shown in FIG. 1, the power means 400 is illustrated in the form of an internal combustion engine. The modes of delivery of power can be varied. For example, as illustrated, the delivery means is powered by a gear box 406 which in turn is powered by shaft 204 coupled through belt drive 402 to the internal combustion engine 400. In addition, on FIG. 2 is can be seen that the shaft 256 of the delivery means continues outward and through belt drive 408 powers the third metering means 342 and thence through shaft 410 and belt drive 412 a feed conveyor apparatus, not shown, inside of bin 340. The pump means 280 is shown as being directly driven by the internal combustion engine 400. The internal combustion engine 400 can in turn through a shaft (not shown) drive a hydraulic pump 300 which in turn through appropriate means could drive either the hydraulic motor 302 of the mix-conveyor 63 or hydraulic motor 310 of homogenizer 62. Any or all of these proposed driving modes can be altered without having any effect on the scope of the present invention. The important feature is the provision of a power means separate and apart from whatever drives the mobile frame. This is so that a uniform mixture of asphalt concrete can be obtained without regard to whether the mobile frame is in motion or standing still.

After reading the foregoing detailed description, it should be apparent that the objects set forth at the outset of the specification have been successfully achieved. The inventive method of the present invention is hereinafter described.

The liquid asphalt cement and the aggregate necessary to form asphalt concrete are carried to a job site, whether it is simply a place or patch or an entire roadway to be resurfaced, in separate containers upon a mobile frame, such as a truck. And all times while in transit or not, the temperature of the liquid asphalt cement is maintained in a range of from about 100° F to about 195° F. The temperature of the aggregate is maintained in a range of from about 70° F to about 250° F. The selection of the particular temperatures to be used on a particular day depends entirely upon the ambient temperature and weather conditions. Upon reaching the place to be worked, the aggregate is metered into a delivery means and delivered to a mixing means. The liquid asphalt cement is pumped and metered to the mixing means. The liquid asphalt cement and the aggregate are thereupon mixed together until homogenous mixture is formed and the resultant homogenous mixture is laid onto a place where the road is to be patched. Agitating and consolidating can then be performed, as desired. It can easily be seen from the foregoing description of the apparatus how each of these steps of the inventive method can be performed.

Additionally, the inventive method can include carrying a filler material in a separate container to the job site and metering the filler material onto the delivery means and mixing the filler material with the liquid asphalt cement and aggregate to produce asphalt concrete. The inventive method can be carried out with the mobile frame in motion or stationary.

The inventive method and the inventive apparatus can be used for a multitude of differing mixtures. Specifically, as noted above when an anionic emulsion liquid asphalt cement is used, the homogenizer 62 is the preferred form of mixing means 60. However, when cationic emulsion liquid asphalt cement is used, the mix-conveyor 63 is preferable because cationic emulsion liquid asphalt cement sets faster and the longer residence time provided homogenizer 62 is not required. The area to be repaired on the road can be primed by means of tacking, as is common in the prior art. An additional spray unit can be mounted on the mobile frame and connected through piping means to the liquid asphalt cement pump means 280 to provide this function. The inventive apparatus and inventive method can be used for the production of Portland cement during the winter months. As a filler material, Portland cement would be contained in the filler hopper 340. Water would be carried in the second tank 350. The inventive method of "warm patching" is suitable for use during the entire year because the extra heat provided by the first and second heating means and/or the infrared heating means accelerates the curing of the asphalt concrete once it is laid so that it does not soften in the sun during the summer months. This enables the roadway repair or resurface to be accomplished much more quickly than any of the prior art methods.

It will now be seen that there is herein provided a highway maintainer which satisfies all of the objectives set forth above, and others, including advantages of great practical utility and commercial importance.

The embodiments of the invention in which an exclusive property or privilege is claimed are defined as follows:

1. A self-contained highway maintainer apparatus comprising, in combination:

an elongated mobile frame having a longitudinal axis;

a storage bin disposed on said frame for storing aggregate;

a first tank disposed on said frame for storing liquid asphalt cement;

a first heating means disposed in said storage bin for maintaining the aggregate at a temperature of from about 70° F to about 250° F;

a second heating means disposed in said first tank for maintaining the liquid asphalt cement at a temperature of from about 100° F to about 195° F;

mixing means attached to said frame including a plurality of mixer elements;

delivery means having a length disposed to receive the aggregate fed from said storage bin and discharge the same into said mixing means;

pump means coupled to said first tank for discharging the liquid asphalt cement from said first tank into said mixing means;

a spreading means connected to said frame and disposed below said mixing means for spreading the materials from said mixing means onto a road surface;

a second tank disposed on said frame for storing water;

a third heating means disposed in said second tank for maintaining the water at a temperature of from about 70° F to about f212° F;

pipe means for directing water from said second tank to said mixing means; and a water metering means interposed in said pipe means for metering the flow of water through said pipe means.

2. The apparatus of claim 1 further comprising a filler hopper for storing a filler material disposed on said frame, a filler metering means operatively associated with said hopper for metering said filler material to said delivery means and wherein said filler material is Portland cement.

3. The apparatus of claim 2 wherein said mixing means comprises a mixing trough longitudinally aligned with said frame and extending rearwardly thereof, said trough having a flexible bottom wall, said trough being pivotably secured to said frame for movement in a horizontal and vertical plane relative to said frame, shaft means extending longitudinally in said trough, said plurality of mixer elements comprising a plurality of spaced apart mixing blades supported on said shaft means; said shaft means also supporting screw conveyors flights thereon, and means for driving said shaft means.

4. The apparatus of claim 1 wherein said third heating means comprises a third heat generating means, a third heat exchange means, and a third vent means, said third heat exchange means being disposed in said second tank.

5. The apparatus of claim 4 wherein said third heat generating means is a burner means combusting a fuel.

6. The apparatus of claim 5, wherein said first and second heat generating means are burner means combusting a fuel.

7. The apparatus of claim 1 further comprising a power means secured on said frame for powering said mixing means, said delivery means, and said pump means.

8. The apparatus of claim 7 wherein said mobile frame is a truck and said power means is an auxiliary internal combustion engine.

9. The apparatus of claim 1, wherein said first heating means comprises a first heat generating means, a first exchange means and a first vent means, said first heat exchange means being disposed within said storage bin, and said second heating means comprises a second heat generating means, a second heat exchange means and a second vent means, said second heat exchange means being disposed within said first tank.

10. The apparatus of claim 9 wherein the first and second heat generating means are burner means combusting a fuel.

11. The apparatus of claim 1 wherein said delivery means comprises an endless conveyor means having a discharge end, said conveyor means being secured to said frame and disposed below said storage bin, said discharge end being positioned above said mixing means and a controllable means for driving said conveyor means.

12. The apparatus of claim 1 further comprising a plurality of infrared heating means disposed above said delivery means along its length attached to said frame for heating said aggregate as it passes.

13. A self-contained highway maintainer apparatus comprising, in combination:

an elongated mobile frame having a longitudinal axis;

a storage bin disposed on said frame for storing aggregate;

a first tank disposed on said frame for storing liquid asphalt cement;

a first heating means disposed in said storage bin for maintaining the aggregate at a temperature of from about 70° F to about 250° F;

a second heating means disposed in said first tank for maintaining the liquid asphalt cement at a temperature of from about 100° F to about 195° F;

mixing means attached to said frame including a plurality of mixer elements;

delivery means having a length disposed to receive the aggregate fed from said storage bin and discharge the same into said mixing means;

pump means coupled to said first tank for discharging the liquid asphalt cement from said first tank into said mixing means; and a spreading means connected to said frame and disposed below said mixing onto a road surface;

said mixing means includes at least three mixing elements aligned perpendicularly to said longitudinal axis of said frame, each of said mixing elements being operatively associated with another, the first mixing element comprising a first shaft having a longitudinal center, and a plurality of first mixing blades in spaced apart relationship on said first shaft, said mixing blades being disposed on said first shaft to direct the materials being mixed towards the longitudinal center of said first shaft, the second mixing element comprising a second shaft aligned parallel to and on the same horizontal plane as said first shaft having a longitudinal center and opposite ends, said centers of said first and second shafts being aligned along the longitudinal axis of said frame, a plurality of second mixing blades disposed on said second shaft in spaced apart relationship and aligned on said second shaft to direct the materials being mixed towards the ends of said second shaft, the third mixing element comprising an auger-conveyor aligned parallel to and directly below said second mixing element having opposite ends and a longitudinal center, said auger--conveyor being arranged to direct the materials being mixed from the ends thereof towards the longitudinal center thereof, and drive means for rotationally driving said mixing elements.

14. The apparatus of claim 13 wherein said mixing means further includes a half-trough having a bottom, one forward wall and end plates, said first mixing element being longitudinally disposed therein, said one forward wall being on the frame side of said mixing means; a second trough having a bottom, end plates, one full side wall, and one partial side wall having two side portions separated by an open central portion, said open central portion corresponding in length and position with said half-trough, said bottom having two openings, one at each end, said second mixing element being disposed in said second trough; and a third closed top trough disposed below and connected to said second trough; having two side walls a top, end plates and a partial bottom, said top having two openings, one at each end, corresponding to said openings in said bottom of said second trough, said partial bottom of said closed trough having a central open portion, said third mixing element being disposed in said closed trough; and bearing means for said first shaft being located on said end plates of said half-trough, for said second shaft in said end plates of said second trough and for said augerconveyor in said end plates of said closed trough;

and said first shaft and said second shaft are operatively associated by means of gears and said second shaft and said auger-conveyor are operatively associated by means of a gears and a link belt.

15. The apparatus of claim 13 further comprising a power means secured on said frame for powering said mixing means, said delivery means, and said pump means.

16. The apparatus of claim 15 wherein said mobile frame is a truck and said power means is an auxiliary internal combustion engine.

17. The apparatus of claim 13 wherein said first heating means comprises a first heat generating means, a first exchange means and a first vent means, said first heat exchange means being disposed within said storage bin, and said second heating means comprises a second heat generating means, a second heat exchange means and a second vent means, said second heat exchange means being disposed within said first tank.

18. The apparatus of claim 17, wherein the first and second heat generating means are burner means combusting a fuel.

19. The apparatus of claim 13, wherein said delivery means comprises an endless conveyor means having a discharge end, said conveyor means being secured to said frame and disposed below said storage bin, said discharge end being positioned above said mixing means and a controllable means for driving said conveyor means.

20. The apparatus of claim 13, further comprising a plurality of infrared heating means disposed above said delivery means along its length attached to said frame for heating said aggregate as it passes.

21. A self-contained highway maintainer apparatus comprising, in combination:

an elongated mobile frame having a longitudinal axis;

a storage bin disposed on said frame for storing aggregate;

a first tank disposed on said frame for storing liquid asphalt cement;

a first heating means disposed in said storage bin for maintaining the aggregate at a temperature of from about 70° F to about 250° F;

a second heating means disposed in said first tank for maintaining the liquid asphalt cement at a temperature of from about 100° F to about 195° F;

mixing means attached to said frame including a plurality of mixer elements;

delivery means having a length disposed to receive the aggregate fed from said storage bin and discharge the same into said mixing means;

pump means coupled to said first tank for discharging the liquid asphalt cement from said first tank into said mixing means;

a spreading means connected to said frame and disposed below said mixing means for spreading the materials from said mixing means onto a road surface;

a first metering means interposed between said pump means and said mixing means for metering the amount of liquid asphalt cement fed to said mixing means;

a filler hopper for storing a filler material disposed on said frame;

a second metering means operatively associated with said storage bin for metering the aggregate fed to said delivery means;

a third metering means operatively associated with said filler hopper for metering said filler material to said delivery means; and a power means secured on said frame for powering said mixing means, said delivery means and said pump means; and wherein said storage bin comprises a plurality of separate compartments for storing a plurality of different aggregates and said second metering means discharges to said delivery means predetermined amounts and ratio of said different aggregates;

said mixing means includes at least three mixing elements aligned perpendicularly to said longitudinal axis of said frame, each of said mixing elements being operatively associated with another, the first mixing element comprising a first shaft having a longitudinal center, and a plurality of first mixing blades in spaced apart relationship on said first shaft, said mixing blades being disposed on said first shaft to direct the materials being mixed towards the longitudinal center of said first shaft, the second mixing element comprising a second shaft aligned parallel to and on the same horizontal plane as said first shaft having a longitudinal plane as said first shaft having a longitudinal center and opposite ends, said centers of said first and second shafts being aligned along the longitudinal axis of said frame, a plurality of second mixing blades disposed on said second shaft in spaced apart relationship and aligned on said second shaft to direct the materials being mixed towards the ends of said second shaft, the third mixing element comprising an auger-conveyor aligned parallel to and directly below said second mixing element having opposite ends and a longitudinal center, said auger-conveyor being arranged to direct the materials being mixed from the ends thereof towards the longitudinal center thereof, and drive means for rotationally driving said mixing elements;

said delivery means comprises an endless conveyor means having a discharge end, said conveyor means being secured to said frame and disposed below said storage bin, said discharge end being positioned above said mixing means and a controllable means for driving said conveyor means;

said mobile frame is a truck; and said power means is an auxiliary internal combustion engine operatively associated with said controllable means for driving said conveyor means, said drive means for rotationally driving said mixing elements, and said pump means.

* * * * *

UNITED STATES PATENT AND TRADEMARK OFFICE

CERTIFICATE OF CORRECTION

PATENT NO. 4,072,435

DATED February 7, 1978

INVENTOR(S) : Ralph W. Coho; John L. Kugle; Robert C.Futty

It is certified that error appears in the above-identified patent and that said Letters Patent are hereby corrected as shown below:

Column 13, line 48, Claim 13, after "mixing" insert -- means for spreading the materials from said mixing means --.

[75] Inventors: The name of Ralph W.Coho should read -- Ralph W. Coho,Jr. --.

Signed and Sealed this

*Twenty-sixth* Day of *February 1980*

[SEAL]

*Attest:*

SIDNEY A. DIAMOND

*Attesting Officer*

*Commissioner of Patents and Trademarks*